United States Patent [19]

Garnett et al.

[11] Patent Number: 4,502,744

[45] Date of Patent: Mar. 5, 1985

[54] SWITCHING CABLE ASSEMBLY

[75] Inventors: Willard R. Garnett, Tupelo, Miss.; Robert L. Scofield, Memphis, Tex.

[73] Assignee: Emerson Electric Co., St. Louis, Mo.

[21] Appl. No.: 554,254

[22] Filed: Nov. 22, 1983

Related U.S. Application Data

[63] Continuation of Ser. No. 435,715, Oct. 21, 1982, abandoned, which is a continuation of Ser. No. 167,924, Jul. 14, 1980, abandoned.

[51] Int. Cl.[3] ..... H01R 3/04

[52] U.S. Cl. ..... 339/14 R; 339/157 R

[58] Field of Search ..... 339/14, 22 R, 91 R, 339/157, 176 R, 176 M

[56] References Cited

U.S. PATENT DOCUMENTS

| | | | |
|---|---|---|---|
| 1,794,777 | 3/1931 | Kliegl | 339/91 R |
| 2,218,545 | 10/1940 | Morten | 339/157 R |
| 3,185,757 | 5/1965 | Phillips | 339/14 R |
| 3,492,625 | 1/1970 | Bromberg | 339/14 R |
| 3,535,638 | 10/1970 | Michelin | 339/157 R |
| 3,867,000 | 2/1975 | Michalak | 339/91 R |
| 3,869,191 | 3/1975 | Tolnar, Jr. et al. | 339/91 R |
| 4,050,768 | 9/1977 | Gumb | 339/154 A |

FOREIGN PATENT DOCUMENTS

| | | | |
|---|---|---|---|
| 1285352 | 1/1962 | France | 339/157 R |

*Primary Examiner*—Joseph H. McGlynn

*Attorney, Agent, or Firm*—Polster, Polster and Lucchesi

[57] ABSTRACT

In a lighting system in which each of a multiplicity of lighting fixtures has a receptable containing a multiplicity of electrical contacts, a switching cable assembly is provided. A pass-through power plug of the assembly has a housing, a stem connector projecting from the housing with a multiplicity of electrical contacts adapted to mate with complementary contacts in the fixture receptacle, a power-in receptacle mounted in the power plug housing and a power-out receptacle mounted in the housing, and electrical conductors electrically connected, mediately or immediately, to and between contacts of the power-in receptacle, contacts of the power-out receptacle and contacts of the stem connector, the stem connector and its complementary fixture receptacle constituting the means for mounting the plug on the system. A switch cable boss in the housing accommodates electrical conductors electrically connected to the electrical conductors between contacts of the power-in receptacle and contacts of the stem connector.

2 Claims, 13 Drawing Figures

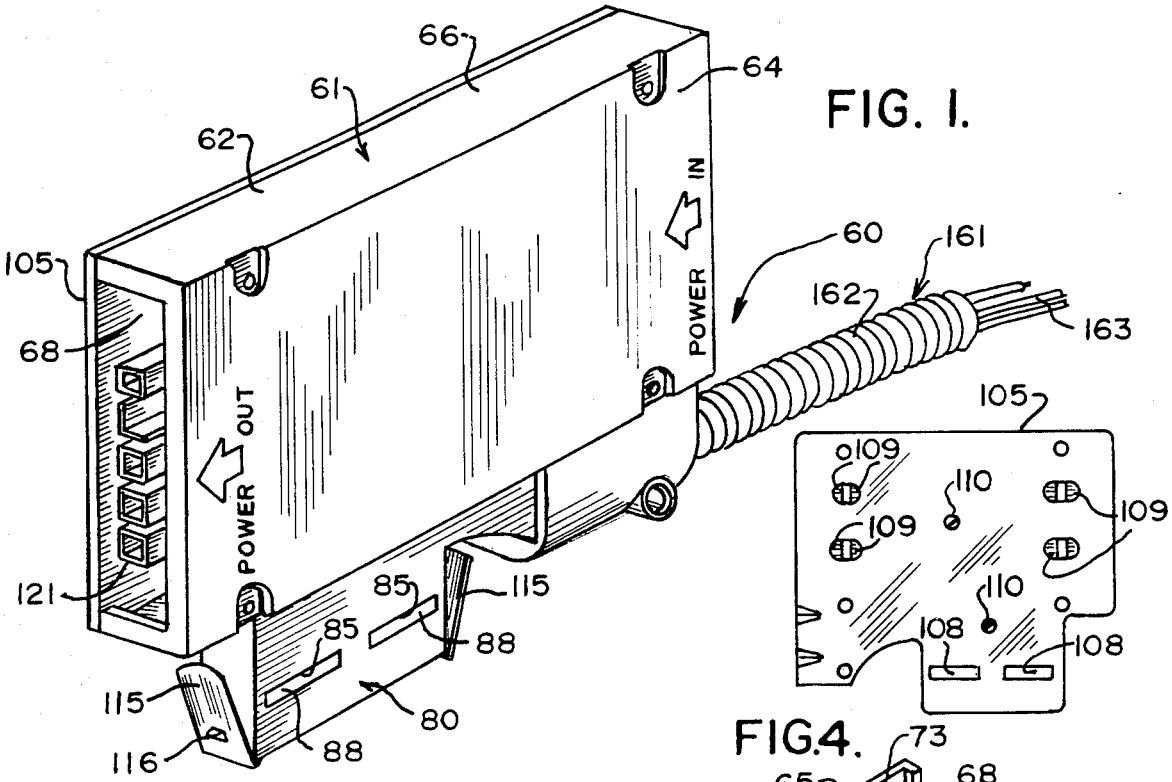
FIG. 1.
FIG.4.
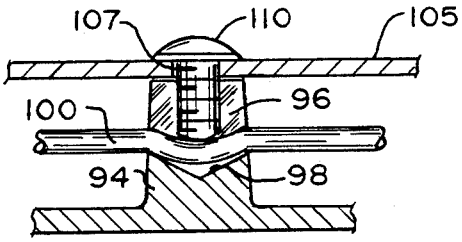
FIG. 3.
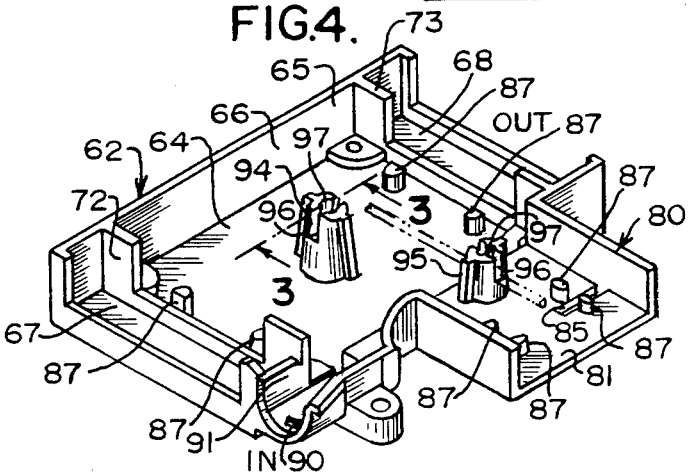
FIG.2.
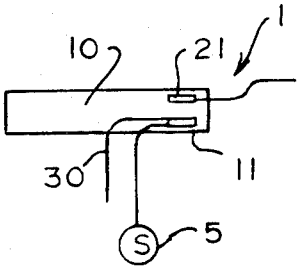
FIG.9A.
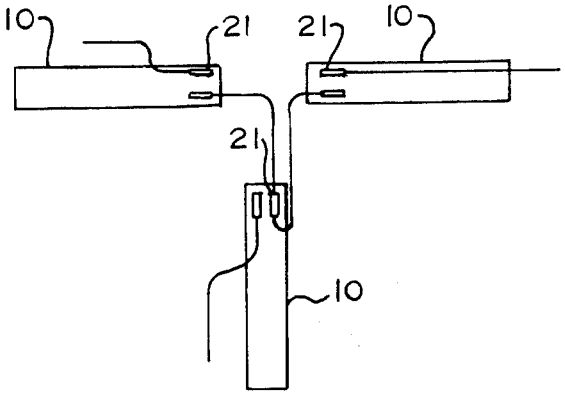
FIG. 10A.

OLD

OLD

SWITCHING CABLE ASSEMBLY

This is a continuation of application Ser. No. 435,715 filed Oct. 21, 1982, now abandoned, which is a continuation of Ser. No. 167,924 filed July 14, 1980, now abandoned.

BACKGROUND OF THE INVENTION

The switching cable assembly of this invention is designed particularly for use with lighting systems of the sort illustrated in Quin U.S. Pat. No. 4,134,045, in which fixtures are provided with receptacles adapted to receive connectors of flexible plug-in power and connecting cables. In the commercial devices now available, separate switch tap boxes and switch tap cable are used, the switch tap boxes being separately mounted and a branch circuit cable between the switch tap box and the first luminaire to be switched being required. Furthermore, Tee junctions have required separate junction boxes, separately mounted.

One of the objects of this invention is to provide a simple, relatively inexpensive cable assembly that eliminates the need for separately mounted switch tap boxes, Tee junction boxes, and branch circuit cables.

Another object is to provide such an assembly that is easily installed.

Another object is to provide an assembly that is securely mountable and sufficiently stable to receive connecting cables.

Still another object is to provide an assembly having a low installed profile to avoid the need for excessive space above suspended ceilings.

Other objects will become apparent to those skilled in the art in the light of the following description and accompanying drawing.

SUMMARY OF THE INVENTION

In accordance with this invention, generally stated, in a lighting system in which each of a multiplicity of lighting fixtures has a receptacle containing a multiplicity of electrical contacts, a switching cable assembly is provided. A pass-through power plug of the assembly has a housing, a stem connector projecting from the housing with a multiplicity of electrical contacts adapted to mate with complementary contacts in the receptacle, a power-in receptacle mounted in the housing and a power-out receptacle in the housing, and electrical conductors electrically connected, mediately or immediately, to and between contacts of the power-in receptacle, contacts of the power-out receptacle and contacts of the stem connector, the stem connector and its complementary fixture receptable constituting the means for mounting the plug on the system. A switch cable boss in the housing accommodates electrical conductors to be electrically connected to the electrical conductors connected between contacts of the power-in receptacle and contacts of the stem connector. The power-in, power-out and stem connector receptacles lie substantially in a common plane.

BRIEF DESCRIPTION OF THE DRAWING

In the drawing,

FIG. 1 is a view in perspective of one illustrative embodiment of pass-through power plug of the switching cable of this invention;

FIG. 2 is a view in perspective of a part of the housing of the plug of FIG. 1, without a cover;

FIG. 3 is a fragmentary sectional view taken along the line 3—3 of FIG. 2, with a cover plate, grounding screw and ground wire in position;

FIG. 4 is a view in side elevation on a reduced scale of the side of the pass-through power plug opposite the one shown in FIG. 1;

FIG. 9A is a somewhat diagrammatic view corresponding to the view shown in FIG. 9, showing the arrangement of lighting fixture with switch connection employing the switching cable assembly of this invention;

FIG. 10A is a somewhat diagrammatic view corresponding to the view shown in FIG. 10, showing the arrangement of lighting fixture with switch connection employing the switching cable assembly of this invention.

DESCRIPTION OF THE PREFERRED EMBODIMENT

Figure 5:
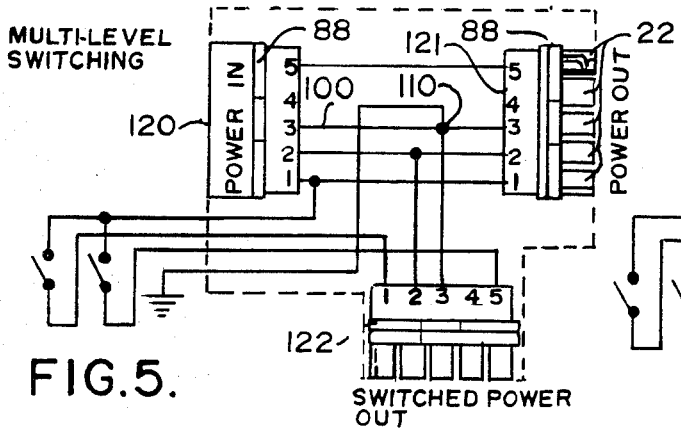
FIGS. 5, 6, 7 and 8 are somewhat diagrammatic views of various different circuit arrangements, illustrating internal wiring to accommodate different lighting system arrangements.
Figure 7:
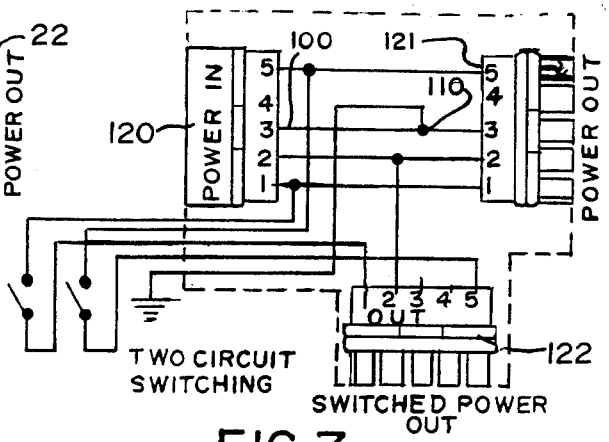
Figure 6:
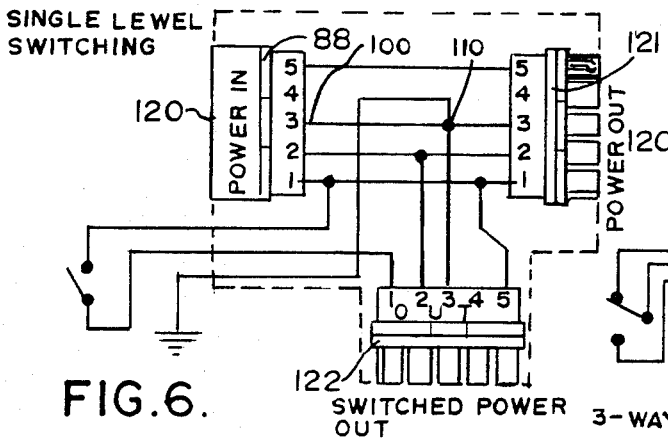
Figure 8:
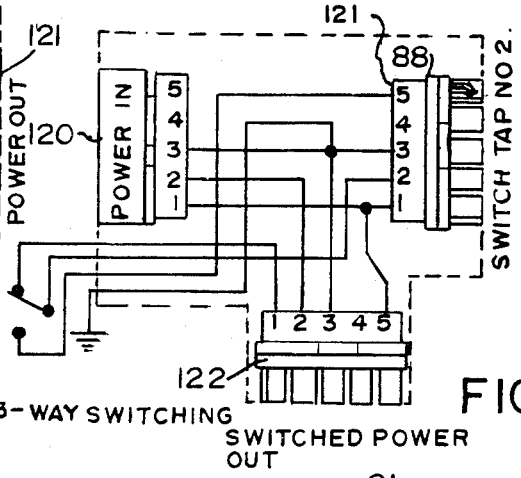
Figure 9:
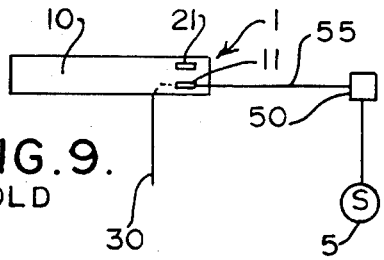
FIG. 9 is a somewhat diagrammatic view showing the conventional arrangement of lighting fixture with switch connection.
Figure 10:
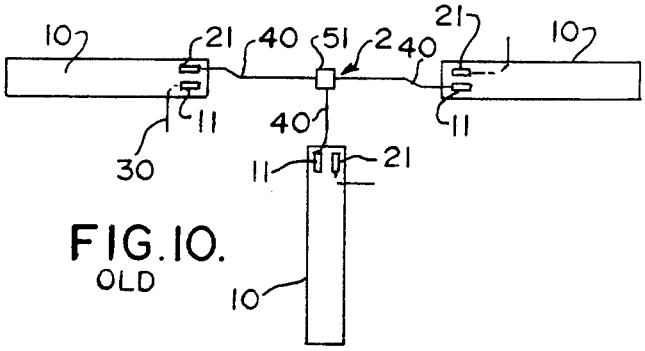
FIG. 10 is a somewhat diagrammatic view showing the conventional arrangement of lighting fixtures with Tee junction.
Figure 11:
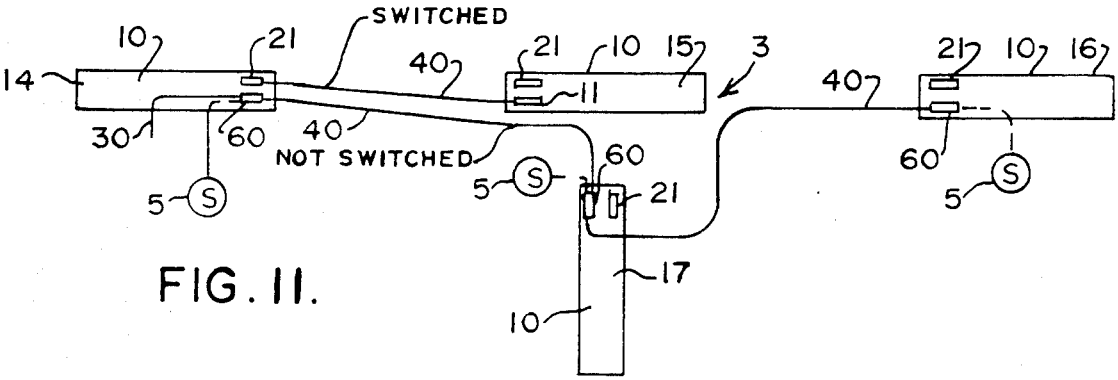
FIG. 11 is a somewhat diagrammatic view of a lighting system employing the switching cable assembly of this invention.

Referring now to the drawing, and particularly to FIGS. 9, 10, and 11, reference numeral 1 indicates a conventional system employing lighting fixtures (luminaires) and cables of the type shown and described in U.S. Pat. No. 4,134,045, and presently sold commercially by the Day-Brite Lighting Division of Emerson Electric Co. under the trademark ELECTRO/CONNECT. In FIG. 9, the system 1 is shown as a single luminaire, with a switch 5, which, in the conventional system shown, requires a separate switch box 50 and branch circuit cable 55. In FIG. 9A, a system corresponding to the system 1 but utilizing the switching cable assembly of this invention is shown. It will be seen that the system shown in FIG. 9A requires neither separate switch box 50 nor branch circuit cable 55. In FIG. 10, a system 2 is shown in which a separate junction box 51 is used at a Tee junction to feed a fixture 10 mounted at right angles to a pair of fixtures in series. In FIG. 10A, a system corresponding to the system 2 but utilizing the switching cable assembly of this invention is shown. It will be seen that no separate junction box 51 is required.

In FIG. 11, a lighting system utilizing the switching cable assembly of this invention shows three fixtures 10 in line, and one at right angles. For convenience of illustration, the three fixtures in line are designated 14, 15 and 16, and the one at right angles, as 17.

In all of the fixtures 10 there are power-in fixture receptacles 11, typically of the type shown in FIG. 3 of U.S. Pat. No. 4,134,,45, with electrical contacts 12, and power-out fixture receptacles 21, with electrical contacts 22. In both of the systems, conventional and new, power is supplied from a power source through a power cable 30 equipped wth a connector plug, and to fixtures electrically connected to the first luminaire through connecting cable 40, equipped with connector plugs at both ends, again as illustrated in U.S. Pat. No. 4,134,045.

Referring now to FIGS. 1 through 4, reference numeral 60 indicates one embodiment of switching cable assembly of this invention. The assembly 60 includes a pass-through power plug 61 and switch cable 161 which, in FIG. 1, is shown as including armored cable 162 and electrical conductors 163.

The pass-through power plug 60 includes a die cast housing box 62, a sheet metal cover plate 105, a power-in receptacle 120, a power-out receptacle 121, and a stem plug receptacle 122.

The housing box 62 has a "bottom" wall 64 (as viewed in FIG. 2), a boundary wall 65, and inner locating walls 72 and 73. The boundary wall 65 and inner locating wall 72 define by their uppermost edges a plane, to accommodate the substantially flat surface of the cover plate 105. The boundary wall 65 includes an uninterrupted upper wall 66. The rest of the boundary wall and the inner locating walls are interrupted to provide power-in receptacle openings 67 and power-out receptacle openings 68. The boundary wall 65, cover plate 105, which is shaped complementarily, and bottom wall 64 also define a stem 80, projecting from the housing on the opposite side from and perpendicularly to the upper wall 66. The stem 80 has an opening 81 in which the stem plug receptacle 122 is seated.

The housing box bottom wall 64 has integral with it various mounting lugs 87 positioned to straddle, in the case of the stem plug receptacle, or engage one side, in the case of the power-in and power-out receptacles, ribs 88 molded on the receptacles. In this embodiment, the bottom wall also has rectangular openings 85 through it, between mounting lugs 87, to cage ribs 88 on the stem plug receptacle 122. All of the receptacles 120, 121 and 122 have ribs 88, interrupted through a center section, on both sides of the receptacle, but the receptacles 120 and 121 are caged by other means than openings.

Also integral with the bottom wall 64 are grounding wire posts 94 and 95, each with a slot 96 opening through and extending from the outer end of the post. A screw-receiving channel 97 extends the length of the slot from the open outer end of the slot to a surface 98 defining the bottom of the slot 96. The bottom surface 98 is depressed at its center, forming a shallow V, as shown particularly in FIG. 3.

On the same side of the housing box 62 as the stem 80, but opening at right angles to the side walls of the stem 80, is a switch cable boss 90, opening through the boundary wall 65 below the receptacle opening 67. The switch cable boss 90 forms a seat 91 for one end of the armored cable 162, and a passage to the interior of the box 62 for electrical conductors to and from a switch 5.

The sheet metal cover plate 105 has grounding screw openings 107 coincident with the screw-receiving channels 97 of the grounding wire posts 94 and 95, to admit grounding screws 110, and mounting screw holes to admit screws threaded into internally threaded screw bosses integral with the bottom wall of the housing box 62, as shown in FIG. 1, to fasten the cover plate 105 to the housing box. The cover plate 105 has rib-receiving openings 108 aligned with and oppositely disposed from the openings 85 in the housing, and locating and mounting tabs 109 lanced inwardly to straddle and embrace the sides of the ribs of receptacles 120 and 121 opposite the ribs on those receptacles that are mounted between long edges of the boundary wall and inner locating walls defining the receptacle openings 67 and 68. The cover plate is also dimpled to embrace and engage the part of the armored cable that is seated in the box seat 91.

The stem plug has a pair of resilient latching elements 115, from which detents 116 are lanced, as shown in FIG. 1, and described and illustrated in U.S. Pat. 4,134,045.

The power plug 61 can be pre-wired for any desired switching arrangement. The wiring diagrams of FIGS. 4 through 8 are merely illustrative. However, each of the wiring arrangements shown is characterized by a ground wire 100 which is preferably stiff and firmly secured to terminals in the receptacles 120 and 121 that are aligned with one another and with the slot 96 of grounding post 94. The ground wire 100 then passes through the slot 96 and is held in tight mechanical and electrical contact with the screw 110 and the post 94 and in electrical contact with the cover plate 105, hence with the armored cable 162. A similar ground wire from the stem plug receptacle 122 is held in mechanical and electrical contact in the slot 96 of the post 95.

Referring now to FIG. 11, it can be seen that the switching cable of assembly 60 of this invention can be used to provide either a simple switching function, by plugging in a pre-wired pass-through power plug, thus eliminating the necessity for a separate switch box and branch circuit cable, or it can be used to provide power to a luminare and a pass-through connection to another luminaire either in the same line or in a different branch, as in a corridor at right angles to the main line of fixtures. In FIG. 11, for example, the luminaire 14 is switched, and the luminaire 15 will, because it is connected to the power-out receptacle of luminaire 14, be switched with the luminaire 14. The luminaire 17, at right angles to the first line of luminaires, is connected to the power-out receptacle of the pass-through power plug plugged into the luminaire 14, by way of its own pass-through power plug plugged into its power-in receptacle, which is, in turn, wired to permit luminaire 17 to be switched independently of the luminaire 14. By way of illustration, the luminaire 16 is shown as connected to the power-out receptacle of the pass-through plug in the "corridor" luminaire 17, by way of its own power plug wired for independent switching.

The stem of the power plug, with its wings or resilient elements 115, plugged into the power-in fixture receptacle, serves as the sole mounting means for the switching cable assembly.

It will be observed that the power-in, power-out and stem receptacles are in a single plane. The power plug projects, in its commercial form, no more than $3\frac{1}{2}''$ above the fixture receptacle. If a fixture receptacle is oriented horizontally rather than vertically, the power plug will require practically no head room beyond that required by the fixture receptacle. The planar arrangement provides a narrow, compact device.

Numerous variations in the construction of the switching cable assembly of this invention, within the scope of the appended claims, will occur to those skilled in the art in the light of the foregoing disclosure. Merely by way of example, the pass-through power plug can be provided without the switching cable, and may even have the seat 91 closed, for use as a pass-through plug alone, without switching. Such a construction may be useful in taking the place of a conventional Tee junction box, for example. The pass-through plug can even be wired only to a switch and the stem receptacle, if no pass-through power connection is to be made. The pass-through plug can be made in different shapes and sizes, and with different means for mounting the cover, and for mounting the receptacles. The housing box can be made differently than by die casting, and the cover plate can be made of something different from sheet metal. These variations are merely illustrative.

Having thus described the invention, what is claimed and desired to be secured by Letters Patent is:

1. In a lighting system in which a plurality of lighting fixtures is electrically connected by a plurality of conductors and each of the said lighting fixtures contains a plurality of wires electrically connected to contacts for connection to a source of power, the improvement comprising a switching cable assembly including a generally rectangular housing adapted to be mounted on a said lighting fixture, said housing having top and bottom walls and oppositely disposed, substantially parallel long side walls, said side walls being narrow as compared with the length and width of the said top and bottom walls, a stem connector integral with and projecting from a said side wall of said housing, and a switch cable boss, integral with and projecting from a said side wall of said housing and defining a passage extending substantially parallel to the length of the said side wall, a power-in receptacle mounted in said housing and having a multiplicity of electrical contacts accessible to and adapted to mate with complementary contacts of a plug-in connector of a power-cable, a power-out receptacle mounted in said housing and having a multiplicity of electrical contacts accessible to and adapted to mate with complementary contacts of a plug-in connector of a connecting cable and a stem plug receptacle mounted in the stem of said housing and having a plurality of electrical contacts accessible to and adapted to mate with said lighting fixture wire contacts, electrical conductors electrically connected to and between contacts of the power-in receptacle and contacts of the power-out receptacle, and a first electrical switch conductor electrically connected at one end to a conductor connected to a contact of the power-in receptacle and at another end, to a switch remote from said lighting fixture, and a second electrical switch conductor electrically connected at one end to another side of said switch and at another end to a said stem plug receptacle contact, said switch conductors extending through a sheath an end of which is mounted in said switch cable boss passage.

2. The improvement of claim 1 wherein each of said lighting fixtures has a receptacle containing said fixture conductor contacts, and said housing includes a grounding post integral with the inner surface of said bottom wall, and resilient latching elements mounted on said stem part and engaging a said fixture receptacle when said stem is mounted therein.

* * * * *

UNITED STATES PATENT AND TRADEMARK OFFICE

CERTIFICATE OF CORRECTION

PATENT NO. : 4,502,744

DATED : March 5, 1985

INVENTOR(S) : Willard R. Garnett et al

It is certified that error appears in the above—identified patent and that said Letters Patent is hereby corrected as shown below:

Column 2, line 62, "4,134,,45" should read "4,134,045"

Signed and Sealed this

First Day of October 1985

[SEAL]

*Attest:*

DONALD J. QUIGG

*Attesting Officer*

*Commissioner of Patents and Trademarks—Designate*